US006971550B2

(12) United States Patent
Kuge et al.

(10) Patent No.: US 6,971,550 B2
(45) Date of Patent: Dec. 6, 2005

(54) SPOUTING STRUCTURE FOR LIQUID CONTAINER AND BAG-IN-BOX CONTAINER

(75) Inventors: Raizo Kuge, Tokyo-to (JP); Kenji Watanabe, Tokyo-to (JP)

(73) Assignee: Kabushiki Kaisha Hosokawa Yoko, Tokyo-to (JP)

( * ) Notice: Subject to any disclaimer, the term of this patent is extended or adjusted under 35 U.S.C. 154(b) by 0 days.

(21) Appl. No.: 10/925,010

(22) Filed: Aug. 25, 2004

(65) Prior Publication Data

US 2005/0045654 A1 Mar. 3, 2005

(30) Foreign Application Priority Data

Aug. 26, 2003 (JP) ..... 2003-301062

(51) Int. Cl.[7] ..... B65D 35/46

(52) U.S. Cl. ..... 222/105; 222/107; 222/559; 53/133.2; 383/96

(58) Field of Search ..... 222/105, 107, 222/559, 563; 53/133.2; 493/213; 215/354; 383/80, 96

(56) References Cited

U.S. PATENT DOCUMENTS

| | | | | |
|---|---|---|---|---|
| 3,108,732 | A * | 10/1963 | Curie et al. | 222/105 |
| 3,521,796 | A * | 7/1970 | Roy | 222/563 |
| 3,738,545 | A * | 6/1973 | Roy | 222/563 |
| 3,949,934 | A * | 4/1976 | Goglio | 222/396 |
| 4,362,255 | A * | 12/1982 | Bond | 222/107 |
| 5,110,041 | A * | 5/1992 | Keeler | 222/562 |
| 5,307,955 | A | 5/1994 | Viegas | |
| 5,731,021 | A | 3/1998 | Spector | |
| 6,402,019 | B1 * | 6/2002 | Casale | 53/133.2 |
| 6,644,510 | B2 * | 11/2003 | Kawolics et al. | 222/105 |
| 6,766,921 | B2 * | 7/2004 | Keller | 222/105 |
| 6,871,764 | B2 * | 3/2005 | Stoneberg et al. | 222/563 |
| 2004/0178220 | A1 * | 9/2004 | Smith | 222/107 |
| 2005/0045654 | A1 * | 3/2005 | Kuge et al. | 222/105 |

FOREIGN PATENT DOCUMENTS

| | | |
|---|---|---|
| EP | 0 274 256 A1 | 7/1988 |
| WO | WO-00/21858 A1 | 4/2000 |

* cited by examiner

*Primary Examiner*—Kenneth Bomberg
(74) *Attorney, Agent, or Firm*—Birch, Stewart, Kolasch & Birch, LLP

(57) ABSTRACT

A spouting structure includes a spout attached to the liquid container and having a mouthpiece, a cap screwed on the spout and having a top wall and a cylindrical protrusion protruding from a central part of the top wall having a bottom wall provided with an opening and defining a cylindrical bore, and a round plate axially movably fitted in the cylindrical bore of the cylindrical protrusion. The cylindrical protrusion protrudes downward from the top wall and is fitted in the mouthpiece of the spout. The round plate is provided with at least one opening in its peripheral part, has a plugging part formed in a central area of the lower surface thereof and capable of being plugged closely in the opening formed in the bottom wall of the cylindrical protrusion of the cap.

8 Claims, 3 Drawing Sheets

SPOUTING STRUCTURE FOR LIQUID CONTAINER AND BAG-IN-BOX CONTAINER

This Nonprovisional application claims priority under 35 U.S.C. § 119(a) on Patent Application No(s). 2003-301062 filed in Japan on Aug. 26, 2003, the entire contents of which are hereby incorporated by reference.

BACKGROUND OF THE INVENTION

1. Field of the Invention

The present invention relates to a spouting structure for a liquid container, such as a bag included in a bag-in-box container, and a bag-in-box container.

2. Description of the Related Art

A bag-in-box container has a bag formed from a plastic film, and a corrugated fiberboard carton containing the bag. Referring to FIG. 5, a bag 100 for a bag-in-box container has a flat bag body 101 formed from a laminated film produced by laminating an oriented nylon film and a polyethylene film, and a spouting structure 102 attached to one of the walls of the bag body 101. The bag 100 of this bag-in-box container is filled with a liquid product, such as mineral water or a fruit beverage, under an aseptic condition to store the liquid product or to transport the liquid product to a desired place.

As shown in FIG. 6, the spouting structure 102 of the bag 100 of the bag-in-box container has a spout 106 including a mouthpiece 104 provided in its outer side surface with an external thread 103 and a flange 105 at its inner end. The external thread 103 and the flange 105 are formed integrally with the mouthpiece 104. A first sealing member 107 is attached to the outer end of the mouthpiece 104 so as to seal the outer opening of the mouthpiece 104 completely, and a second sealing member 108 is attached to the lower surface of the flange 105 so as to seal the inner opening of the mouthpiece 104 partially. The bag 100 thus formed is irradiated with gamma rays for sterilization.

When filling a liquid product, such as a fruit beverage, into the bag 100, the first sealing member 107 completely sealing the outer opening formed in the mouthpiece 104 of the spout 106 is broken, a filling nozzle is connected to the spout 106, and the liquid product is poured from the filling nozzle through the outer opening of the mouthpiece 104 and the inner opening of the mouthpiece 104 partially sealed by the second sealing member 108 into the bag 100. After the bag 100 has been filled with a predetermined quantity of the liquid product, the filling nozzle is disconnected from the mouthpiece 104, and the second sealing member 108 partially sealing the inner opening of the mouthpiece 104 is attached by a sealing means to the flange 105 to seal the inner opening completely.

The spout 106 of the spouting structure 102 attached to the bag 100 of this bag-in-box container has the outer opening completely sealed by the first sealing member 107, and the inner opening partially sealed by the second sealing member 108. The first sealing member 107 is broken to power the liquid product into the bag 100. The second sealing member 108 is attached to the flange 105 by the sealing means so as to seal the inner opening of the mouthpiece 104 completely after the bag 100 has been filled with the predetermined quantity of the liquid product. Thus the liquid product cannot easily be filled into the bag 100 and the bag 100 cannot be reused. It is difficult to attach the second sealing member 108 satisfactorily to the lower surface of the flange 105 to seal the inner opening because the lower surface of the flange 105 is wet.

SUMMARY OF THE INVENTION

The present invention has been made in view of the foregoing problems and it is therefore an object of the present invention to provide a spout structure for a liquid container included in a bag-in-box container facilitating work for filling a liquid into the liquid container and makes it possible to reuse the liquid container.

Another object of the present invention is to provide a bag-in-box container including a liquid container provided with the foregoing spouting structure.

A spouting structure in a first aspect of the present invention for a liquid container includes: a spout attached to the liquid container, having a mouthpiece provide with an external thread in its outer side surface, and a flange formed integrally with the mouthpiece at the lower end of the latter; a cap having a top wall, a cylindrical skirt extending downward from the circumference of the top wall and provided with an internal thread mating with the external thread of the mouthpiece, and a cylindrical protrusion protruding downward from a central part of the top wall, having a cylindrical bore opening in the top wall and a bottom wall provided with an opening, and fitted in the mouthpiece of the spout; and a round plate provided with at least one opening in its peripheral part, fitted in the cylindrical bore of the cylindrical protrusion so as to be axially movable, and having a plugging part formed in a central area of a lower surface thereof and capable of being plugged closely in the opening formed in the bottom wall of the cylindrical protrusion of the cap.

A liquid product can be filled through the opening formed in the bottom wall of the cylindrical protrusion of the cap screwed on the spout. The round plate is moved toward the bottom wall of the cylindrical protrusion of the cap to plug the plugging part in the opening formed in the bottom wall of the cylindrical protrusion of the cap to seal the liquid container after the liquid container has been filled with the liquid product poured through a filling nozzle into the liquid container. Thus the liquid container can be easily filled with the liquid product by a series of simple operations.

The bag-in-box container includes a bag provided with the spouting structure according to the present invention, and a box containing the bag.

The spouting structure of the present invention for a liquid container includes the spout attached to the liquid container, having a mouthpiece provide with an external thread in its outer side surface, the cap having the cylindrical protrusion protruding downward from the central part of the top wall, having the cylindrical bore opening in the top wall and the bottom wall provided with the opening, and fitted in the mouthpiece of the spout, and the round plate provided with at least one opening in its peripheral part, fitted in the cylindrical bore of the cylindrical protrusion so as to be axially movable, and having the plugging part formed in the central area of the lower surface thereof and capable of being plugged closely in the opening formed in the bottom wall of the cylindrical protrusion of the cap. Thus the liquid container can be filled with the liquid product under an aseptic condition without removing the cap from the spout, and the spout can be sealed at the last stage of the filling operation.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
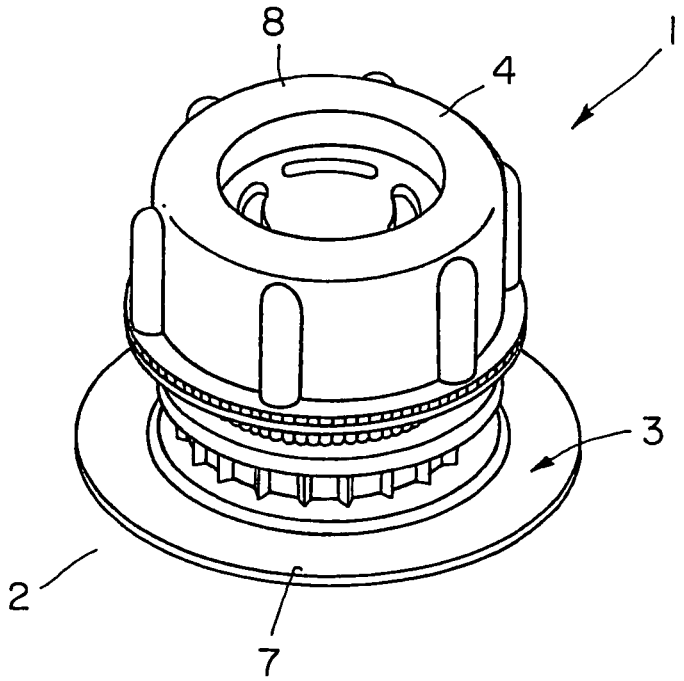
FIG. 1 is a perspective view of a spouting structure in a preferred embodiment according to the present invention for a liquid container.

Referring to FIG. 1, a spouting structure 1 in a preferred embodiment according to the present invention for a liquid container includes a spout 3 bonded to a liquid container 2, such as a bag included in a bag-in-box container, and a cap 4 screwed on the spout 3. The spout 3 and the cap 4 are formed of a polyolefin resin. The liquid container 2 is formed from a laminated film produced by laminating an oriented nylon film, a polyethylene film and a low-density polyethylene film by a conventional forming method.

Figure 3:
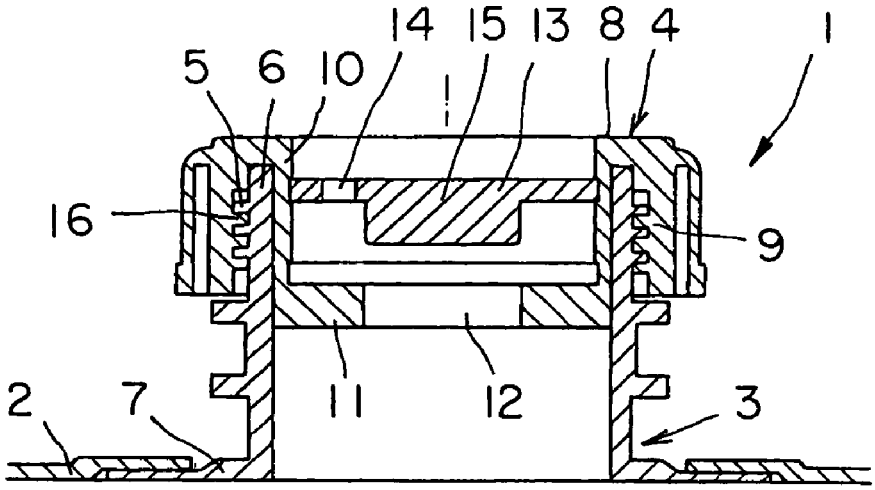
FIG. 3 is a sectional view taken on the line A—A in FIG. 2.

Referring to FIG. 3, the spout 3 has a mouthpiece 6 provided with an external thread 5 in its outer side surface, and a flange 7 formed integrally with the mouthpiece 6. The flange 7 is placed inside the liquid container 2 with its upper surface in contact with the liquid container 2. The flange 7 is bonded to the inner surface of the liquid container by an ordinary bonding means to connect the spout 3 to the liquid container 2.

As shown in FIG. 3, the cap 4 has a top wall 8, a cylindrical skirt 9 extending downward from the outer circumference of the top wall 8, and a cylindrical protrusion 10 protruding from a central part of the top wall 8. The cylindrical protrusion 10 has an open upper end and a bottom wall 11 provided with an opening 12. The cylindrical protrusion 10 is formed in an outside diameter such that the cylindrical protrusion 10 can be fitted in the mouthpiece 6 of the spout 3. A round plate 13 is fitted in the bore of the cylindrical protrusion 10 so as to be axially movable.

Figure 2:
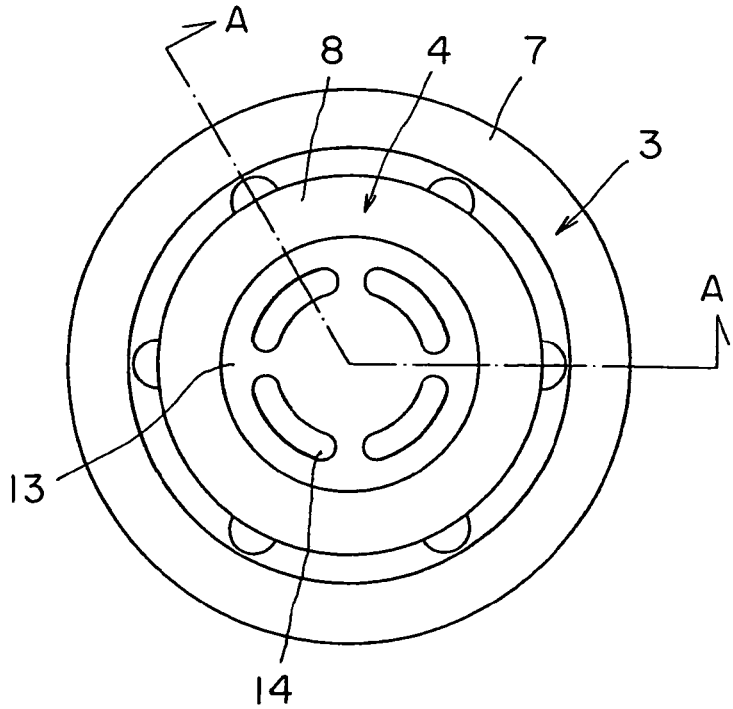
FIG. 2 is a top plan view of the spouting structure shown in FIG. 1.
Figure 4:
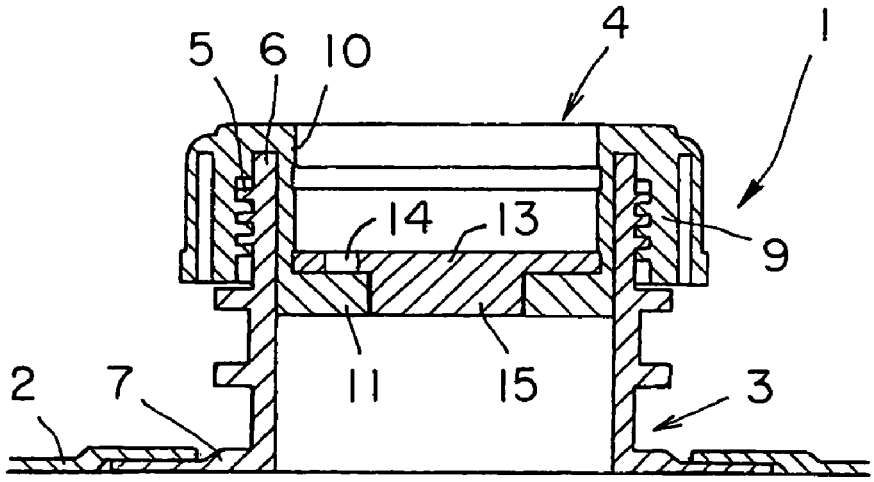
FIG. 4 is a sectional view of the spouting structure shown in FIG. 1 in a sealing state.
Figure 5:
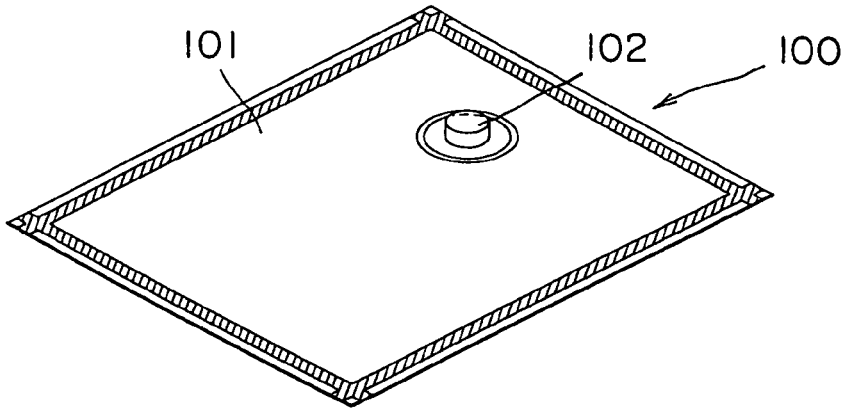
FIG. 5 is a perspective view of a bag included in a conventional bag-in-box container.
Figure 6:
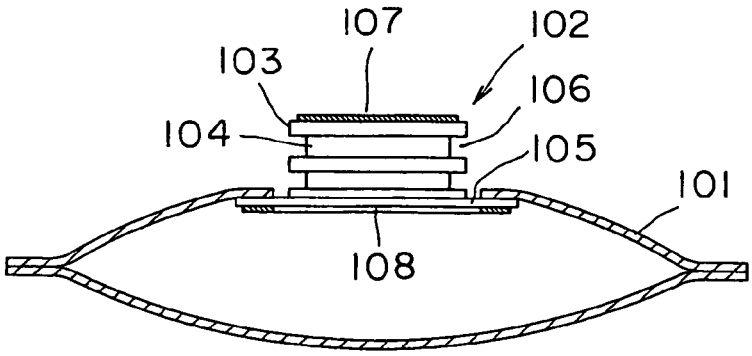
FIG. 6 is a sectional view of a spouting structure attached to the bag shown in FIG. 5.
Figure 7:
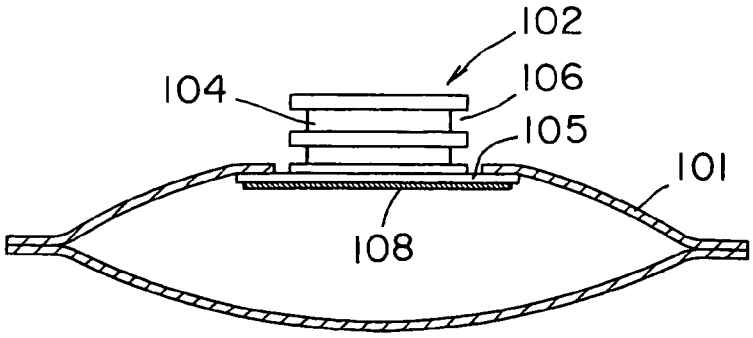
FIG. 7 is a sectional of the spouting structure shown in FIG. 6 in a sealing state.

Referring to FIGS. 2 and 3, the round plate 13 has a plugging part 15 formed in a central area of the lower surface thereof and capable of being closely plugged in the opening 12 of the bottom wall 11 of the cap 4. The round plate 13 is provided with four curved openings 14 having the shape of a circular arc and arranged on a circle. The plugging part has the shape of a thin cylinder. The round plate 13 can be closely fitted in a lower part of the cylindrical protrusion 10. The round plate 13 can be immovably held at a closing position by closely plugging the plugging part 15 in the opening 12. The axial length, namely, the vertical dimension as viewed in FIG. 3, of the opening 12 is approximately equal to the thickness of the plugging part 15. When the plugging part 15 is plugged closely in the opening 12 to close the opening 12 as shown in FIG. 4, the lower end surface of the plugging part 15 is substantially flush with the lower surface of the bottom wall 11. Since the lower end surface of the plugging part 15 is substantially flush with the lower surface of the bottom wall 11, dirt is hardly able to remain on the lower end surfaces of the plugging part 15 and the bottom wall 11.

The openings 14 of the round plate 13 are arranged symmetrically with respect to the center of the round plate 13. The openings 14 have the shape of an arc of a circle having its center at the center of the round plate 13. The number of the openings 14 of the round plate 13 does not need to be four as shown in FIG. 2, but may be any suitable number as the occasion demands. Circular openings may be formed instead of the openings 14 having the shape of a circular arc on a circle in the round plate 13.

The cylindrical skirt 9 of the cap 4 is provided with an internal thread 16 mating with the external thread 5 of the mouthpiece 6 of the spout 3.

The cap 4 is screwed on the spout 3, and a sealing sheet, not shown, formed by processing a laminated film produced by laminating a polyester film and an olefin resin film is attached to the top wall 8 of the cap 4 so as to cover the open end of the cap 4 to keep the liquid container 2 provided with the spouting structure 1 in an aseptic state before the liquid container 2 is used.

The liquid container 2 provided with the spouting structure 1 of the present invention is put in a corrugated fiberboard carton to form a bag-in-box container.

The operation of the spouting structure 1 of the present invention will be described. The sealing sheet is attached to the top wall 8 of the cap 4 so as to cover at least the upper open end of the top wall 8 before the liquid container 2 is used. As shown in FIG. 3, the round plate 13 fitted in the cylindrical protrusion 10 of the cap 4 screwed on the spout 3 bonded to the liquid container 2 is in an upper part of the cylindrical protrusion 10. Therefore, the plugging part 15 of the round plate 13 is held outside the opening 12 to open the opening 12. To fill a liquid product, such as a fruit beverage, into the liquid container 2, the sealing sheet attached to the top wall 8 of the cap 4 is pierced or broken, a filling nozzle of a liquid pouring device, not shown, is joined to the cylindrical protrusion 10 of the cap 4, and the liquid product is poured through the filling nozzle into the cylindrical protrusion 10. Then, the liquid product flows from the cylindrical protrusion 10 protruding from the top wall 8 of the cap 4 through the openings 14 of the round plate 13, the opening 12 of the bottom wall 11 of the cylindrical protrusion 10, and the spout 3 into the liquid container 2. After the liquid container 2 has been filled with a predetermined quantity of the liquid product, the filling nozzle is removed from the cylindrical protrusion 10 of the cap 4, a pressing rod of a pressing device, not shown, is inserted in the cylindrical protrusion 10 of the cap 4 to depress the round plate 13 such that the plugging part 15 of the round plate 13 is forced into the opening 12 formed in the bottom wall 11 of the cylindrical protrusion 10. Consequently, the spout 3 of the liquid container 2 is closed completely by the cap 4. Thus the liquid product, such as a beverage, can be filled into the liquid container provided with the spouting structure of the present invention and the liquid container can be sealed by a series of operations under an aseptic condition. The liquid product contained in the liquid container provided with the spouting structure of the present invention can be transported to a desired place in an aseptic state.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. A spouting structure for a liquid container, comprising:

a spout attached to the liquid container, having a mouthpiece provided with an external thread in its outer side surface, and a flange formed integrally with the mouthpiece at a lower end of the latter;

a cap having a top wall, a cylindrical skirt extending downward from a circumference of the top wall and provided with an internal thread mating with the external thread of the mouthpiece, and a cylindrical protrusion protruding downward from a central part of the top wall, having a cylindrical bore opening in the top wall, a bottom wall provided with an opening and fitted in the mouthpiece of the spout; and a round plate provided with at least one opening in its peripheral part, fitted in the cylindrical bore of the cylindrical protrusion so as to be axially movable, and having a plugging part formed in a central area of a lower surface thereof and capable of being plugged closely in the opening formed in the bottom wall of the cylindrical protrusion of the cap.

2. The spouting structure according to claim 1, wherein a film is attached to the top wall of the cap.

3. The spouting structure according to claim 1, wherein the plugging part is cylindrical.

4. The spouting structure according to claim 1, wherein the plugging part has a thickness substantially equal to an axial dimension of the opening formed in the bottom wall of the cylindrical protrusion.

5. The spouting structure according to claim 1, wherein the round plate is provided with a plurality of openings arranged symmetrically with respect to a center of the round plate.

6. The spouting structure according to claim 1, wherein the round plate is provided with a plurality of openings having the shape of a circular arc and arranged on a circle having its center at a center of the round plate.

7. The spouting structure according to claim 1, wherein the round plate, the spout and the cap are formed of a polyolefin resin, and the liquid container is formed from a laminated film produced by laminating an oriented nylon film, a polyethylene film and a low-density polyethylene film.

8. A bag-in-box container comprising:

a bag provided with the spouting structure according to claim 1; and a box containing the bag.

* * * * *